US008257516B2

(12) United States Patent
Im et al.

(10) Patent No.: US 8,257,516 B2
(45) Date of Patent: Sep. 4, 2012

(54) METHOD FOR MANUFACTURING SUPER STRONG STEEL BODY FOR MANUFACTURE OF PRODUCTS WITH COMPLICATED SHAPE

(75) Inventors: Hee Joong Im, Gyeonggi-Do (KR); Seung Man Nam, Seoul (KR); Man Been Moon, Gyeonggi-Do (KR); Sang Muk Na, Jeollanam-Do (KR); Sung Namkoong, Seoul (KR)

(73) Assignee: Hyundai Hysco (KR)

( * ) Notice: Subject to any disclaimer, the term of this patent is extended or adjusted under 35 U.S.C. 154(b) by 175 days.

(21) Appl. No.: 12/746,845

(22) PCT Filed: May 27, 2009

(86) PCT No.: PCT/KR2009/002791

§ 371 (c)(1),
(2), (4) Date: Jun. 8, 2010

(87) PCT Pub. No.: WO2010/044530

PCT Pub. Date: Apr. 22, 2010

(65) Prior Publication Data

US 2010/0269962 A1 Oct. 28, 2010

(30) Foreign Application Priority Data

Oct. 16, 2008 (KR) ..... 10-2008-0101778

(51) Int. Cl.
*C21D 8/00* (2006.01)

(52) U.S. Cl. ..... 148/647; 148/645; 148/649; 148/650; 148/651; 72/379.6; 72/379.2

(58) Field of Classification Search ..... 148/645–647, 148/649, 650, 651; 72/379.6, 379.2
See application file for complete search history.

(56) References Cited

U.S. PATENT DOCUMENTS

| | | | | |
|---|---|---|---|---|
| 6,878,220 | B2 * | 4/2005 | Gehringhoff et al. | 148/654 |
| 7,004,004 | B2 | 2/2006 | Arns et al. | |
| 2006/0219334 | A1 * | 10/2006 | Brodt et al. | 148/647 |
| 2007/0144632 | A1 | 6/2007 | Toyoda et al. | |
| 2010/0026048 | A1 | 2/2010 | Vlot et al. | |

FOREIGN PATENT DOCUMENTS

| | | |
|---|---|---|
| JP | 08-150421 | 6/1996 |
| JP | 2005-238286 | 9/2005 |
| JP | 2008-509284 | 3/2008 |
| JP | 2008119702 | 5/2008 |

* cited by examiner

*Primary Examiner* — Deborah Yee
(74) *Attorney, Agent, or Firm* — Baker & Hostetler LLP

(57) ABSTRACT

The present invention relates to a method of manufacturing ultra-high strength steel products and, more particularly, to a method of manufacturing ultra-high strength steel products suitable for production of articles having a complicated shape or a high processing depth. The method includes preparing a steel sheet by blanking the steel sheet having hardenability to form a rough shape of a final product, cold-pressing the steel sheet to form a 50~80% shape of the final product, precisely trimming the cold-formed steel sheet along a contour line corresponding to an outer contour of the final product, and hot-pressing the trimmed product to form the remaining 20~50% shape of the final product and quenching simultaneous with hot-pressing, after heating the trimmed product to an austenite region of 700° C. or more.

8 Claims, 3 Drawing Sheets

【Fig. 1】
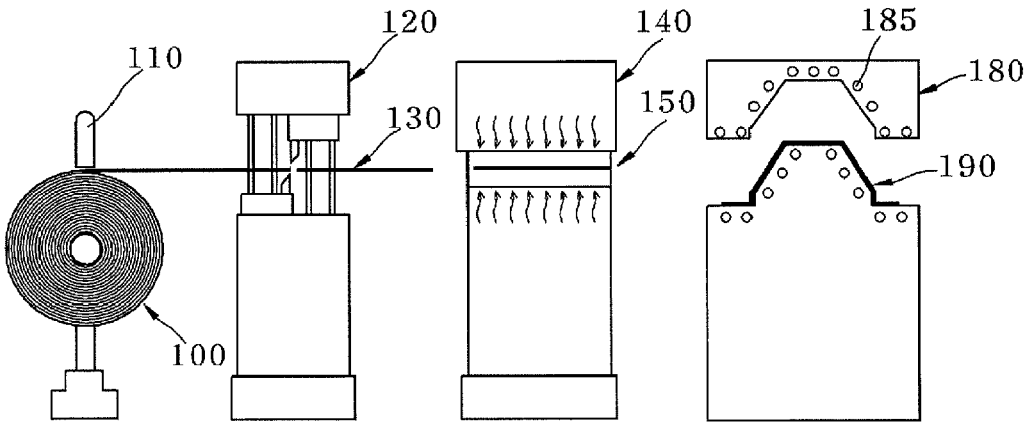
【Fig. 2】
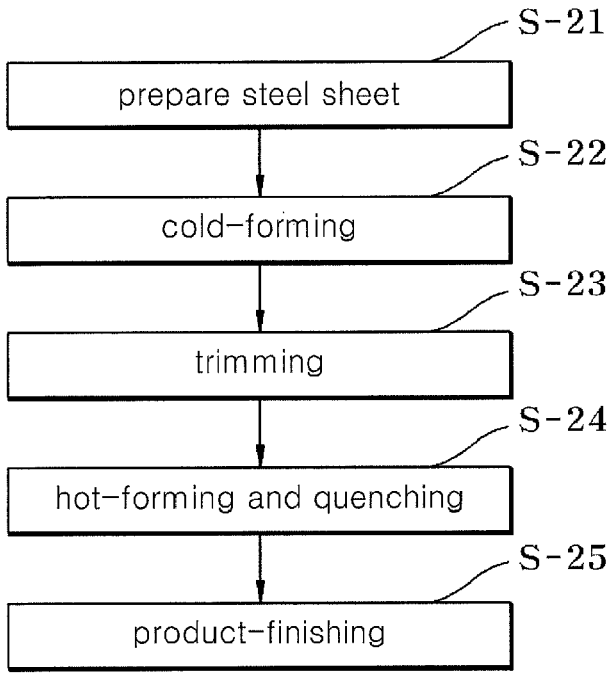

【Fig. 3】
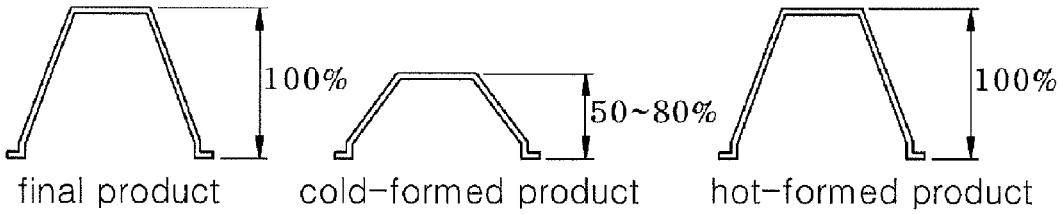

【Fig. 4】
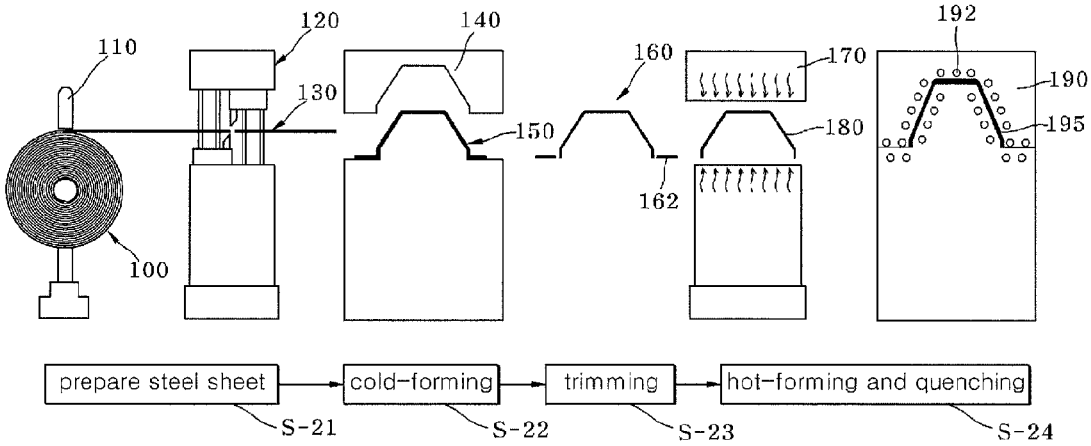

METHOD FOR MANUFACTURING SUPER STRONG STEEL BODY FOR MANUFACTURE OF PRODUCTS WITH COMPLICATED SHAPE

TECHNICAL FIELD

The present invention relates to a method of manufacturing ultra-high strength steel products and, more particularly, to a method of manufacturing ultra-high strength steel products, which is suitable for production of products having a complicated shape or a high processing depth.

BACKGROUND ART

Recently, vehicle impact performance criteria for ensuring safety of passengers have become increasingly stringent. In addition, as regulations regarding carbon dioxide emissions serving as a main cause of global warming have been strengthened, improvements in fuel efficiency have been consistently demanded. For this purpose, vehicles must satisfy requirements for both sufficient frame strength and light weight.

An ultra-high strength steel sheet enables a vehicle to achieve desired strength using a thinner steel sheet.

In a conventional process for manufacturing vehicle components using an ultra-high strength steel sheet, a steel coil is initially cut to a steel sheet, which in turn is subjected to blanking into a rough shape and is then heated to an austenite region. Then, the heated steel sheet is transferred to dies, in which the steel sheet is formed to a desired shape of a component while being quenched with the formed product secured in the dies, thereby providing a high strength component with high dimensional accuracy.

FIG. 1 is a flow diagram of a conventional manufacturing method of steel products.

As shown in this figure, a steel coil 100 is unwound from a coil support 110 and passed through a cutter 120 to form a steel sheet 130. Then, the steel sheet 130 is subjected to blanking to provide a blanked steel sheet 150, which in turn is passed through a heating furnace 140 for heating the blanked steel sheet 150. The heated steel sheet 150 is then subjected to hot-forming in dies 180 to form a product 190. The dies 180 are formed with a fluid passage 185, through which a coolant or cooling water is supplied to cool the dies and the product at the same time, with the dies closed.

Here, the product must be sheared to a precise size by a shearing machine, but the ultra-high strength steel product formed by the above process has too high a strength (about 1500 MPa) to be sheared to a precise size using the shearing machine, so that too high a cutting force is required for cutting and the tool wear rate is high, thereby increasing manufacturing costs.

Further, when shearing the steel product, burrs are severely formed and increase the likelihood of cracking in a component made of the product according to notch sensitivity of a high strength material.

To solve such problems, laser cutting or water jet cutting is generally used for the shearing process. Although laser cutting or water jet cutting provides a very clean and high quality cutting surface, process time can be extended depending on the material thickness, shearing length, accuracy of dimensional tolerance, and the like. As a result, the shearing process can often cause extension in the process time of the overall manufacturing process.

Furthermore, in formation of a product having a high processing depth or a complex shape, excessive deformation occurs during hot-forming, thereby causing local damage or product defects.

DISCLOSURE

Technical Problem

An aspect of the present invention is to provide a method of manufacturing ultra-high strength steel products, which is suitable for production of products having a complicated shape or a high processing depth.

The present invention is directed to providing a method of manufacturing an ultra-high strength steel product, which includes cold-forming to form 50~80% of the product and hot-forming to form the remainder of the product, thereby preventing damage or defects of the product from being generated during formation of the product.

Technical Solution

In accordance with an aspect of the present invention, a method of manufacturing an ultra-high strength steel product includes: preparing a steel sheet by blanking the steel sheet having hardenability to form a rough shape of a final product; cold-pressing the steel sheet to form a 50~80% shape of the final product; precisely trimming the cold-formed steel sheet along a contour line corresponding to an outer contour of the final product; and hot-pressing the trimmed product to form a remaining 20~50% shape of the final product and quenching simultaneous with hot-pressing, after heating the trimmed product to an austenite region of 700° C. or more.

Advantageous Effects

According to an embodiment of the invention, in the manufacturing method of the ultra-high strength steel product, a 50~80% shape of a final product is formed by cold-forming and the remainder of the final product is formed by hot-forming, thereby preventing damage to or defects in the product, which could be generated when forming the product through a single process, by which a large amount of the steel sheet is processed.

Further, according to an embodiment of the invention, punching is performed, as needed, during product finishing after hot-forming and quenching, thereby preventing an error of a punching position caused by deformation of the product during hot-forming.

Further, according to an embodiment of the invention, the steel sheet is cut into a shape as close to a final shape of the product as possible in the step of trimming, so that a post-process using a laser beam or water jet after hardening can be minimized, thereby preventing problems of the conventional post-process relating to manufacturing costs and production rate.

DESCRIPTION OF DRAWINGS

FIG. 1 is a schematic flow diagram of a conventional method of manufacturing a steel product;

FIG. 2 is a flowchart of a method of manufacturing a steel product in accordance with an embodiment of the present invention;

FIG. 3 is a conceptual view illustrating degrees of forming of a final product, a cold-formed product, and a hot-formed product in the manufacturing method in accordance with the embodiment of the present invention; and FIG. 4 is a schematic flow diagram of the manufacturing method in accordance with the embodiment of the present invention.

BEST MODE

Embodiments of the invention will now be described in detail with reference to the accompanying drawings.

It should be noted that the drawings are not to precise scale and may be exaggerated in thickness of lines or sizes of components for descriptive convenience and clarity only.

Furthermore, the terms as used herein are defined by taking functions of the invention into account and can be changed according to the custom or intention of users or operators.

Therefore, definition of the terms should be made according to the overall disclosure set forth herein.

A method of manufacturing an ultra-high strength steel product and a steel product manufactured thereby in accordance with an embodiment of the invention will be described with reference to the accompanying drawings.

FIG. 2 is a flowchart of a method of manufacturing a steel product in accordance with an embodiment of the invention, FIG. 3 is a conceptual view illustrating degrees of forming of a final product, a cold-formed product, and a hot-formed product in the manufacturing method in accordance with the embodiment of the invention, and FIG. 4 is a schematic flow diagram of the manufacturing method in accordance with the embodiment of the invention.

Referring to FIG. 2, a manufacturing method of an ultra-high strength steel product according to an embodiment includes: a) preparing a steel sheet by blanking the steel sheet having hardenability to form a rough shape of a final product in S-21; b) cold-pressing of cold-forming the steel sheet to form a 50~80% shape of the final product in S-22; c) precisely trimming the cold-formed steel sheet along a contour line corresponding to an outer contour of the final product in S-23; d) hot-pressing or hot-forming the trimmed product to form the remaining 20~50% shape of the final product and quenching simultaneous with hot-pressing, after heating the trimmed product to an austenite region of 700° C. or more, in S-24; and e) product-finishing by carrying out final trimming and punching of the hot-formed product, as needed, using a laser beam or water jet in S-25.

The present invention is characterized in that a 50~80% shape of the final product is formed by cold-forming in S-22 and the remaining shape of the final product is formed by hot-forming.

Here, the forming ratio relates to a three-dimensional shape and it is thus ambiguous to define the ratio as a numeric value. In this invention, the forming ratio is defined as a ratio of a height (or depth) of a formed product at a certain forming step to that of a final product. For example, if a final product has a height of 500 mm after processing and a material for the final product is subjected to blanking to have a height of 350 mm in cold-forming, the forming ratio becomes 70%.

Referring to FIG. 3, when forming a final product, for example, as shown in the left side of FIG. 3, a hot-formed product as shown in the right side of the figure is formed through a cold-formed product as shown at the center of the figure.

In cold-forming, a 50~80% shape of the final product is formed. Then, the cold-formed product is sequentially subjected to trimming, heating to an austenite region, and hot-forming to form the remaining shape of the product, thereby providing the final product.

Such sequential forming steps can reduce damage to or deformation of a surface of the product, fracture, or the like, as compared with forming the product through a single process, by which a large amount of the steel sheet is processed.

If a 50% or less shape of the final product is formed by cold-forming, a hot-forming amount increases to provide a large difference in shape between the cold-formed product and the final product, so that accurate prediction on the shape of the final product in the trimming step becomes difficult, thereby increasing a work amount by a post-process such as additional laser cutting or the like.

On the contrary, if an 80% or more shape of the final product is formed by cold-forming, a cold-forming amount increases excessively, thereby causing cracks or other damage on the surface of the product during the cold-forming.

The step of trimming (S-23) is a process of trimming the cold-formed product into a shape as close to that of the final product as possible by predicting the shape of the cold-formed product after hot-forming and quenching.

Since the step of trimming (S-23) is performed before hardening, it can be more easily and accurately performed than the post-process.

In the step of trimming (S-23), the cold-formed product is trimmed to form a shape as close to that of the final product as possible by predicting the shape of the final product in consideration of a component shape, factors, such as the kind, composition and thickness of a material, and the like.

For a product having a complex outer shape, some problems can occur when accurate prediction of deformation amount after hot-forming is difficult. In this case, a margin may be locally provided only to a portion of the product, shape prediction of which is difficult, and the portion having the margin may be cut to a final shape by laser cutting or the like in the step of product-finishing, thereby achieving dimensional accuracy of the overall product.

In the step of trimming (S-23), unnecessary portions (portions except for the product per se) are removed from the product before hot-forming and quenching (S-24), whereby most cutting operations for the product are performed before the product undergoes an increase in strength by quenching, thereby improving operation efficiency.

The step of product-finishing (S-25) is a process of finishing the product to have a final shape using a laser beam or water jet and punching the product at a needed position thereof when a complete product shape cannot be obtained by the step of trimming (S-23). The step of product-finishing (S-25) may be omitted depending on the shape of the final product.

In other words, the steel sheet is cut in a range permitting accurate trimming through trial and error in the step of trimming (S-23), and an outer line of the steel sheet, accurate prediction of which cannot be obtained, is locally provided with a margin for cutting and is subjected to precise cutting into a final shape in the step of product-finishing (S-25). Therefore, for a simple product, the cutting operation for the final shape may be omitted in the step of product-finishing.

Punching can be more easily performed at high strength than trimming. Thus, it is desirable to perform punching in the step of product-finishing (S-25).

When punching is performed before hot-forming and quenching, there can be an error of a punching position due to non-uniform elongation or twisting of the material during the hot-forming and quenching.

Referring to FIG. 4, individual processes of the method will be described in more detail.

The manufacturing method of a steel product according to this embodiment may provide an ultra-high strength steel product of an 1180 MPa level using a steel sheet of about 590 MPa level.

First, in the step of preparing a steel sheet (S-21), a hot-rolled steel coil is subjected to cutting or blanking to prepare a steel sheet. In the flow diagram, a steel coil 100 is unwound from a support 110 and passed through a cutter 120 to form a steel sheet 130.

Here, the steel sheet 130 may comprise C: 0.1~0.4% by weight (wt %), Si: 0.5 wt % or less, N: 0.1 wt % or less, Al: 0.01~0.1 wt %, P: 0.05 wt % or less, Mn: 0.8~2 wt %, B: 0.002~0.01 wt %, Mo or Cr: 0.1~0.5 wt %, and the balance of Fe and unavoidable impurities.

With this composition, the steel sheet has a tensile strength of about 550~650 MPa and the final steel product has a tensile strength of about 1300~1600 MPa due to quenching effects.

To perform pressing of the steel sheet, an extra space of the steel sheet to be secured by a holder is required in addition to portions of the steel sheet corresponding to the shape of the final product. This extra space is required until the step of cold-forming (S-22). In this invention, since the forming operation is performed twice and most deformation of the steel sheet occurs by cold-forming, there is no need for the extra space to be secured by the holder in the step of hot-forming.

The step of cold-forming (S-22) is performed to form the steel sheet 130 into a 50~80% shape of the final product, in which the steel sheet 130 has a tensile strength of about 590 MPa. Even at this tensile strength, however, dimensional accuracy can be unsatisfactory due to a spring-back phenomenon and there is a high possibility of generating defects due to a great deformation amount in cold-forming when a processing depth is high. Therefore, the steel sheet may be formed into a 50~80% shape of the final product by cold-forming and the remaining shape of the final product may be obtained by the step of hot-forming and quenching (S-24).

In the step of cold-forming (S-22), the steel sheet is not processed to dimensional accuracy of the final product, but is processed to a presently obtainable dimensional accuracy.

After the step of cold-forming (S-22), an unnecessary portion 162 is removed from the steel sheet except for a product shape 160 in the step of trimming (S-23). Although the step of cold-forming (S-22) requires the extra space to be secured by the holder due to a large processing amount, hot-forming (S-24) involves a small deformation amount and thus does not require the extra space to be secured by the holder. Further, since the steel sheet has an increased strength and is difficult to be cut after hot-forming (S-24), the unnecessary portion 162 is removed from the steel sheet except for the product shape 160 in the step of trimming (S-23) such that an outer shape of the steel sheet is formed as close to the shape of the final product as possible.

Although punching can be performed in the step of trimming (S-23), the shape or position of a punched hole can be changed due to deformation during hot-forming, and thus, punching is preferably performed in the step of product-finishing (S-25).

In the step of hot-forming and quenching (S-24), the trimmed product 180 after the step of trimming (S-23) is heated to a high temperature and subjected to hot-forming in dies and quenching simultaneous therewith, thereby increasing the strength of the product 180 to two or three times the initial strength of the steel sheet through quenching effects.

The final ultra-high strength steel product manufactured by the method according to the embodiment has a tensile strength of 1180 MPa or more.

In the step of hot-forming and quenching (S-24), the trimmed product 180 is passed through a heating furnace 170 in which the product 180 is heated to an austenite region of 700° C. or more, and preferably in the range of 700~990° C. Here, the heating rate may be in the range of 5~80° C./sec but is not limited thereto. A heating rate of 5° C./sec or less is inefficient due to excessively low productivity and a heating rate of 80° C./sec or more can cause evaporation of a coating layer from the steel sheet. Thus, the heating rate may be restricted to 80° C./sec or less.

Generally, in order to obtain a martensite structure, it is essential to consider a relationship between a martensite transformation starting temperature and a quenching rate. In other words, forming must be started at the martensite transformation starting temperature or more and a finished product must be ejected from dies 190 at a martensite transformation finishing temperature or less.

In the heating furnace 170, the final heating temperature of the trimmed product may be from an austenite stabilization temperature or more to 990° C. or less, and the trimmed product is maintained for 3~6 minutes at a heated temperature. The reason behind this is that steel is generally heated to an austenite stabilization temperature in order to obtain a microstructure capable of guaranteeing desired strength of a target product after quenching, and that, if the steel is heated above 950° C., the coating layer can be evaporated from the surface of the steel sheet 130.

Further, the maintenance time is provided to obtain uniform structure through removal of stress from the product 180 and to secure uniform processability in a process after heating. According to experiments, when the maintenance time of the product 180 was less than 3 minutes in the heating furnace 140, residual austenite was not sufficiently formed, whereas if the maintenance time exceeded 6 minutes, austenite grains were grown, causing a slight decrease in the strength of the final product after quenching. Thus, the maintenance time may be in the range of 3~6 minutes.

After heating, the trimmed product 180 is subjected to hot forming to form a product 195, which is quenched together with the press dies 190 compressing the product 195, thereby providing an ultra-high strength steel product having good dimensional accuracy.

Since the quenching is performed simultaneous with hot-forming, the dies 190 are formed with a fluid passage 192, through which a coolant or cooling water flows. Here, the fluid passage 192 is generally formed to penetrate the dies 190 and such a design of the fluid passage 192 in the dies 190 does not limit the scope of the invention.

Here, the quenching rate may be maintained at 20° C./sec or more to facilitate phase transformation into a martensite structure.

In other words, when the product 195 heated to high temperature is cooled at a quenching rate of 20° C./sec or less, the microstructure of the product 195 is transformed into a pearlite or bainite microstructure, which does not provide sufficient strength. Accordingly, it is desirable that quenching be performed at this rate to allow the base iron structure of the product to be completely transformed into a martensite structure.

Finally, product-finishing of the steel product ejected from the dies 190 is performed using a laser beam or water-jet, as needed.

With the manufacturing method according to this invention, high strength components of cars, such as center pillar reinforcement bars, roof-side reinforcement bars, and sill-side reinforcement bars can be easily manufactured.

Here, the center-pillar reinforcement bar is a pillar-shaped component located between a front door and a rear door of a car, the roof-side reinforcement bar is a component constituting a door frame of a car body, and the sill-side reinforcement bar is a component located under a foot support of the car body. All of these components require ultra-high strength and the manufacturing method of the invention can easily manufacture steel products of high strength while improving dimensional accuracy and productivity thereof.

The manufacturing method of the steel product according to the invention is not restricted to a particular material and thus can be applied to all bare materials having no coating layer and coated materials (aluminum-based materials such as Al—Si, etc., or zinc-based materials such as Zn—Fe, etc.).

Although some embodiments of the invention have been described with reference to the accompanying drawings, it will be apparent to those skilled in the art that these embodiments are given by way of illustration only, and that various modifications, changes, and alterations can be made without departing from the spirit and scope of the invention. The scope of the invention should be limited only by the accompanying claims and equivalents thereof.

The invention claimed is:

1. A method of manufacturing an ultra-high strength steel product, comprising:

a) preparing a steel sheet by blanking the steel sheet having hardenability to cut the steel sheet;

b) cold-pressing the steel sheet to produce a cold-formed product having a shape with only between about 50-80% of the dimensional accuracy of a final product;

c) trimming the cold-formed product of step (b) along a contour line corresponding to an outer contour of the final product;

d) hot-pressing the trimmed product of step (c) for forming the remaining 20-50% shape of the final product and quenching simultaneous with hot-pressing, after heating the trimmed product to an austenite region of 700° C. or more; and e) product-finishing by carrying out final trimming and punching of the hot-formed product using a laser beam or water-jet.

2. The method according to claim 1, wherein the trimming in step (c) comprises trimming the cold-formed product into a shape as close to a shape of the final product as possible through trial and error.

3. The method according to claim 1, wherein the trimming in step (c) comprises trimming the cold-formed product into a shape as close to a shape of the final product as possible through trial and error, while locally providing a margin to a contour portion of the cold-formed product, shape prediction of which is difficult.

4. The method according to claim 3, wherein the step of product-finishing comprises cutting the contour portion of the cold-formed steel sheet, to which the margin is provided in the step of trimming, into a final shape.

5. The method according to claim 1, wherein the steel sheet comprises C: 0.1~0.4 wt %, Si: 0.5 wt % or less, N: 0.1 wt % or less, Al: 0.01~0.1 wt %, P: 0.05 wt % or less, Mn: 0.8~2 wt %, B: 0.002~0.01 wt %, Mo or Cr: 0.1~0.5 wt %, and the balance of Fe and unavoidable impurities.

6. The method according to claim 1, wherein the steel product obtained after hot-pressing and quenching has a strength of 1180 MPa or more.

7. The method according to claim 1, wherein, in the step of hot-pressing and quenching, the trimmed steel sheet is heated at a rate of 5-80° C./sec.

8. The method according to claim 1, wherein quenching is performed at a rate of 20° C./sec or more.

* * * * *